US007521864B2

(12) United States Patent
Ishige et al.

(10) Patent No.: US 7,521,864 B2
(45) Date of Patent: Apr. 21, 2009

(54) ELECTRON DEVICE WITH RING-LESS GETTER, METHOD FOR AFFIXING RING-LESS GETTER, AND METHOD FOR ACTIVATING THE SAME

(75) Inventors: Shogo Ishige, Mobara (JP); Yoshihisa Yonezawa, Mobara (JP); Yukio Ogawa, Mobara (JP)

(73) Assignee: Futaba Corporation, Mobara-shi, Chiba-ken (JP)

( * ) Notice: Subject to any disclaimer, the term of this patent is extended or adjusted under 35 U.S.C. 154(b) by 464 days.

(21) Appl. No.: 10/513,777

(22) PCT Filed: May 8, 2003

(86) PCT No.: PCT/JP03/05772

§ 371 (c)(1),
(2), (4) Date: Jun. 14, 2005

(87) PCT Pub. No.: WO03/096373

PCT Pub. Date: Nov. 20, 2003

(65) Prior Publication Data

US 2005/0231096 A1 Oct. 20, 2005

(30) Foreign Application Priority Data

May 10, 2002 (JP) ..... 2002-136338

(51) Int. Cl.
*H01J 17/24* (2006.01)
*H01J 19/70* (2006.01)
*H01J 61/26* (2006.01)

(52) U.S. Cl. ..... 313/553; 313/554; 313/561; 313/562; 313/549; 313/547; 252/181.1; 252/181.5; 252/194

(58) Field of Classification Search ..... 313/553, 313/481, 545–549, 550–562; 252/181.1, 252/181.5, 194
See application file for complete search history.

(56) References Cited

U.S. PATENT DOCUMENTS

| | | | | |
|---|---|---|---|---|
| 5,751,107 | A * | 5/1998 | Komatsu | 313/496 |
| 5,977,706 | A * | 11/1999 | Cho et al. | 313/553 |
| 6,127,777 | A * | 10/2000 | Watkins et al. | 313/554 |
| 6,322,720 | B1 * | 11/2001 | Reutova et al. | 252/181.7 |
| 2001/0024078 | A1 * | 9/2001 | Dimitrijevic et al. | 313/311 |

FOREIGN PATENT DOCUMENTS

| | | |
|---|---|---|
| JP | 2000260357 | 9/2000 |
| JP | 2000311638 | 10/2000 |

* cited by examiner

*Primary Examiner*—Nimeshkumar D. Patel
*Assistant Examiner*—Thomas A Hollweg
(74) *Attorney, Agent, or Firm*—Quarles & Brady LLP; Benjamin J. Peirce

(57) ABSTRACT

An electron device such as a fluorescent display tube is provided, wherein a simple ring-less getter can be simply fixed and arranged with a large degree of freedom. The ring-less getter is securely fixed to the inner surface of the glass anode substrate using laser beams. The laser beam is irradiated onto the ring-less getter from outside the anode substrate. Thus, the laser beam passes through the anode substrate thus heating and melting the ring-less getter. The corresponding inner surface of the anode substrate is melted through the heating. In cooling, the portion where the ring-less getter and the anode substrate are in a molten state is solidified, so that the ring-less getter is bonded to the anode substrate. The ring-less getter is shaped arbitrarily through press-working a getter material.

20 Claims, 7 Drawing Sheets

ELECTRON DEVICE WITH RING-LESS GETTER, METHOD FOR AFFIXING RING-LESS GETTER, AND METHOD FOR ACTIVATING THE SAME

CROSS-REFERENCE TO RELATED APPLICATIONS

This application claims priority to International Patent Application PCT/JP03/05772, filed 08 May 2003, which claims priority of JP application 2002-136338 filed 10 May 2002.

TECHNICAL FIELD

The present invention relates to electron devices with ring-less getters, suitable in use for electron tubes (such as fluorescent display tubes, CRTs, Plasma Display Panels (PDPs), and the like) and electroluminescent displays (ELDs). Moreover, the present invention relates to a method for fixing a ring-less getter and a method for activating the same.

BACKGROUND

In electron devices, such as electron tubes and ELDs, the hermetic container contains a getter. The getter is heated and activated by illuminating radio waves or laser beams from the outside. Thus, the getter adsorbs gases or moisture within the envelope or emits specific gases. For example, when the electron tube belongs to a vacuum tube, the getter adsorbs gases existing in the envelope, thus increasing the degree of vacuum. When the electron tube belongs to a discharge tube, the getter adsorbs unnecessary gas or harmful gas, other than a discharging gas having xenon or neon as a principal constituent, introduced in the envelope. In the case of ELDs, the getter adsorbs moisture within the hermetic container to prolong the serviceable life.

A fluorescent display tube, in which a conventional getter is mounted, will be explained below by referring to FIGS. 7 and 8. In FIGS. 7 and 8, like numerals are attached to the common constituent elements.

FIG. 7 is a cross-sectional view illustrating a fluorescent display tube in which a conventional ring getter is mounted.

FIG. 7(*a*) is a cross-sectional view illustrating the portion taken along the line Y2-Y2 in FIG. 7(*b*). FIG. 7(*b*) is a cross-sectional view illustrating the portion taken along the line Y1-Y1 in FIG. 7 (*a*) . Anode electrodes 55, each on which a fluorescent substance is coated, are formed on a glass substrate 511. The mounting member 52 of the holder member (anchor or support) 531 for cathode filaments 532 is formed on a glass substrate 511. A ring container 541, which is filled with a getter material 542, is welded to the getter holder member 543. Grids 56 are disposed between each anode electrode 55 and the filaments 532. Numeral 512 represents a glass front substrate. Each of numerals 513 to 515 represents a glass side plate. Anode wiring conductors, Nesa films on the front substrate, and others are omitted here.

The ring container 541, being an nickel-plated iron envelope, is filled with a getter material 542, made of a mixture of Ba, Ma, or an alloy of them and an additive metal (such as Al or Ni).

In order to activate the ring getter 54, the ring container 541 is heated through the high-frequency induction heating from outside the fluorescent display tube to flush (evaporating) the getter material 542. The particles of the evaporated getter material 542 make a getter mirror film over an inner surface of the front substrate 543.

The ring getter 54, having a special ring container 541 and a special holder member 543, is difficult to be miniaturized and requires a large mounting space. The ring getter container 541 has to be spaced at least 1 mm from the anode substrate 511 because the anode substrate 511 may be cracked during heating. This makes it difficult to miniaturize and thin the fluorescent display tube. Moreover, both the ring container 541 and the holder member 543 lead to higher machining costs. The difficult work for mounting them increases the fabrication cost of the fluorescent display tube.

The mounting place of the ring getter 54 is limited to the metal component such as the mounting member 52. Hence, there is no degree of freedom in the arrangement of the ring getter 54.

In order to improve the drawback of the ring getter shown in FIG. 7, the ring getter shown in FIG. 8, which does not use the special ring container or the special holder member, has been proposed.

Referring to FIG. 8(*a*), a ring-less getter 54 is formed of an pocket (or a recess), which is filled with a getter material, in the inner surface of the front substrate 512 (refer to Japanese Patent Laid-open Publication No. Tokkai-Hei 5-114373). In this example, the pocket formed in the front substrate 512 leads to the high machining cost. However, the ring-less getter is filled with a necessary amount of getter material enough to provide a getter effect because a deep pocket cannot be made sufficiently.

Referring to FIG. 8(*b*), using the screen printing or vacuum deposition, the film ring-less getter 54, made of a thick or thick film getter material, is formed in the inner surface of the front substrate 512 (refer to Patent Publication No. WO93/16484). In this example, the thick or thin ring-less getter 54 cannot hold a necessary amount of getter material to provide a sufficient getter effect.

The ring-less getter 54 of FIG. 8(*c*) may be considered in place of the ring-less getter of FIGS. 8(*a*) and 8(*b*). In the ring-less getter 54 shown in FIG. 8(*c*), the getter material is sintered in the form of a disc of a diameter of 2 mm and a thickness of 0.5 mm. The ring-less getter 54 is attached to the inner surface of the front substrate 512 with the fritted glass 57. In this example, the ring-less getter 54 having a large thickness can hold a sufficient amount of getter material. However, because the adhesive strength, particularly, the adhesive strength between the ring-less getter and the fritted glass, is not strong (the shear strength is less than 1 N), the ring-less getter 54 may be dropped down during the fabrication process of the fluorescent display tube.

Because the getter material deteriorates at high sintering temperatures (for example, BaAl4 is oxidized), the fritted glass for adhesion is sintered at a low sintering temperature (for example, less than 450° C.) in the atmosphere. However, the low sintering temperature causes the residue of an organic constituent (for example, ethyl cellulose) in the fritted glass paste, thus resulting in deterioration of the reliability of the fluorescent display tube. Moreover, in order to flush the ring-less getter 54 with the laser beam, the laser beam reaching the fritted glass 57 releases a large amount of gases, so that the emission of the filament 532 is degraded remarkably.

The present invention is made to solve the above-mentioned problems in the conventional ring getters and the conventional ring-less getters.

An object of the invention is to provide an electron device with a ring-less getter. The ring-less getter has a simple configuration and a degree of freedom in arrangement. Moreover, the ring-less getter is easily mountable and is suitable for miniaturization and thinning of electron devices, such as electron tubes or ELDs. Moreover, the ring-less getter does not cause cracking of a glass substrate due to heating during mounting or during flushing and does not generate gases deteriorating the function of an electron tube.

Moreover, another object of the invention is to provide a method for fixing a ring-getter and a method for activating the same.

SUMMARY

In an aspect of the present invention, an electron device comprises a glass substrate disposed in a hermetic container, and a ring-less getter bonded onto the glass substrate, with an optical energy.

In another aspect of the present invention, an electron device comprises a glass substrate disposed in a hermetic container, a ring-less getter bonded onto the glass substrate, with an optical energy, and a getter mirror film formed by activating the ring-less getter bonded with an optical energy.

In the electron device, the optical energy is a laser beam.

In the electron device, the glass substrate builds part of the hermetic container.

In the electron device, the ring-less getter is made through press-working a getter material powder.

In another aspect of the present invention, an electron device comprises a resin hermetic container, and a ring-less getter bonded onto an inner surface of the resin hermetic container, with an optical energy.

In further another aspect of the present invention, a method for fixing a ring-less getter, comprises the steps of disposing a ring-less getter on a glass substrate in an electron device, irradiating an optical energy onto the ring-less getter from a surface of the glass substrate, opposite to a surface of the glass substrate on which the ring-less getter is disposed, and bonding the ring-less getter on the glass substrate.

In the method, the optical energy is a laser beam. In still another aspect of the invention, a method for activating a ring-less getter, comprises the steps of disposing a ring-less getter on a glass substrate in an electron device, irradiating an optical energy onto the ring-less getter from a surface of the glass substrate, opposite to a surface of the glass substrate on which the ring-less getter is disposed, bonding the ring-less getter on the glass substrate, and irradiating an optical energy the ring-less getter to activate the ring-less getter.

In the method, the optical energy is a laser beam.

BRIEF DESCRIPTION OF THE DRAWINGS

This and other objects, features, and advantages of the present invention will become more apparent upon a reading of the following detailed description and drawings, in which.

DETAILED DESCRIPTION

A fluorescent display tube (being one of electron devices), a ring-less getter fixing method, and a ring-less getter activating method, according to an embodiment of the present invention, will be described below by referring to FIGS. 1 to 6. Like numerals are attached to the same constituent elements.

Figure 1A:
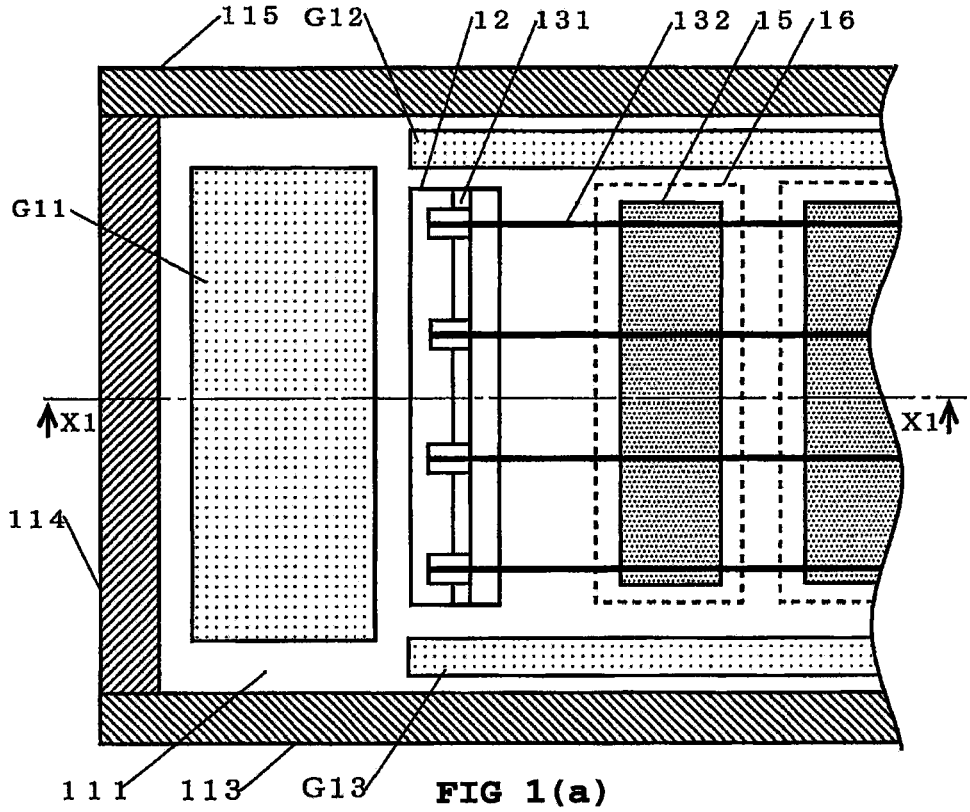
FIGS. 1(*a*) and 1(*b*) are cross-sectional views, each illustrating a fluorescent display tube according to a first embodiment of the present invention.
Figure 1B:
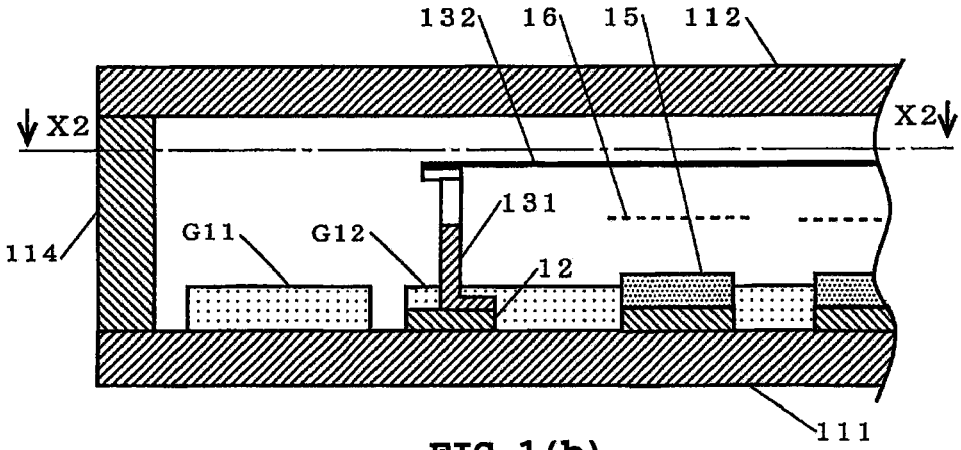

FIG. 1 is a cross-sectional view illustrating a fluorescent display tube according to a first embodiment of the present invention. FIG. 1(*a*) is a cross-sectional view illustrating a portion taken along the line X2-X2 in the arrow direction, shown in FIG. 1(*b*). FIG. 1(*b*) is a cross-sectional view illustrating a portion taken along the line X1-X1 in the arrow direction, shown in FIG. 1(*a*).

Referring to FIG. 1(*a*), numeral 111 represents a glass substrate, 112 represents a glass front substrate, and 113 to 115 represent a glass side plate, and 12 represents a mounting member of a filament holder member (anchor or support) formed of a metal plate. Numeral 131 represents a filament holder member formed of a metal member such as 426 alloy (Ni of 45%, Cr of 6%, Fe (remainder)). Numeral 132 represents a cathode filament, which is formed of W or Re—W core on which an electron emissive material such as ternary carbonate is coated. Numeral 15 represents an anode electrode formed of a metal film such as aluminum on which a fluorescent substance such as ZnO:Zn is coated. Numeral 16 represents a grid, which is formed of a stainless steel or 426 alloy disposed between the filament 132 and the anode electrode 15. Each of numerals G11 to G13 represents a ring-less getter.

The ring-less getter, G11 to G13, is made through press molding a mixed powder of powder such as BaAl4 and MgAl, or a mixed powder of $BaAl_4$ and MgAl and an additive metal (such as Ni, Ti, or Fe).

An envelope, or a hermetic container, of a fluorescent display tube is built with the anode substrate 111, the front substrate 112 and the side plates 113 to 115. When the side plates are integrally made in a box-like form with the anode substrate 111 or the front substrate 112, the side plates can be omitted.

The ring-less getters G11 to G13 are bonded directly to the inner surface of the anode substrate 111 by means of the laser beam illuminated from outside the anode substrate, without using adhesive means such as an adhesive agent, (as described later) . When the ring-less getters G11 to G13 are selected in size, a single ring-less getter or plural ring-less getters may be used. The number of ring-less getters G11 to G13 depends on the total amount of the getter material needed for adsorbing gases generated in the fluorescent display tube and hence is selected according to the amount of gas.

The ring-less getter, G11 to G13, can be press molded in a given shape. By preparing plural ring-less getters corresponding to the form of the dead space of the anode substrate 111, the dead space can be effectively utilized as a ring-less getter fixing place.

Figure 2A:
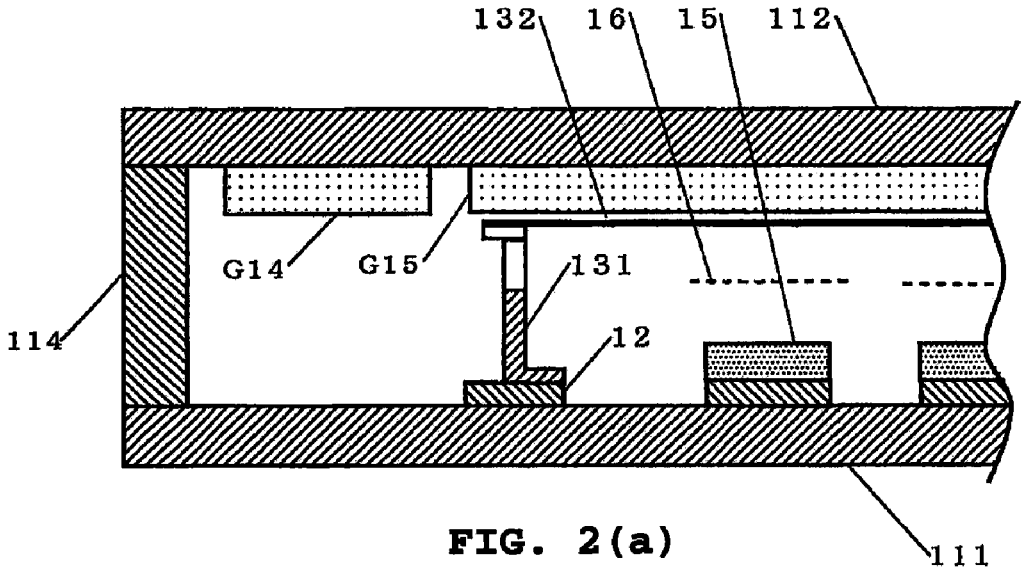
FIGS. 2(*a*) and 2(*b*) are cross-sectional views, each illustrating a fluorescent display tube according to a second embodiment of the present invention.
Figure 2B:
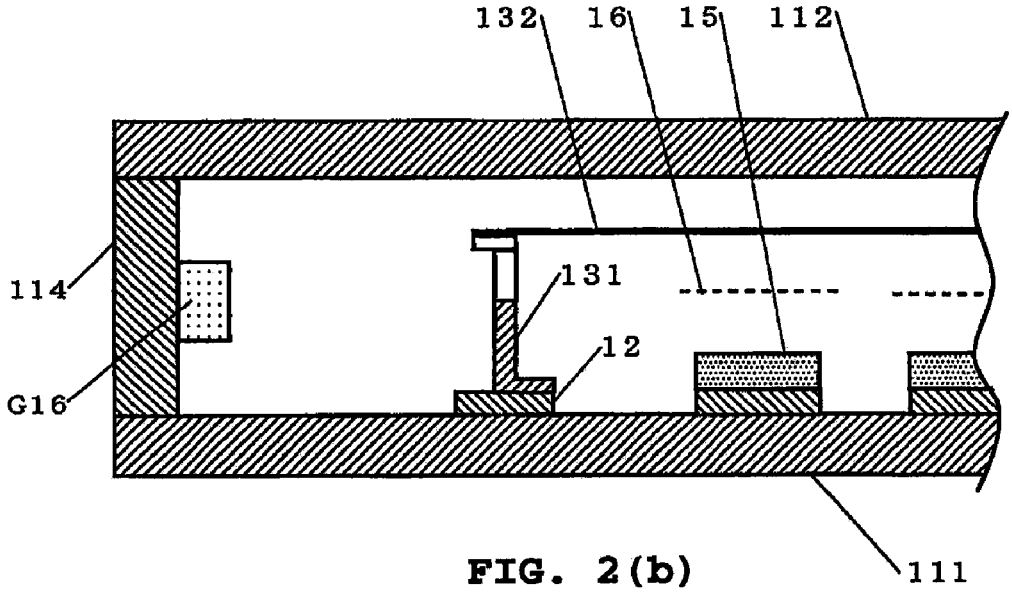

FIG. 2(*a*) shows an example where the ring-less getter G14, G15 is fixed on the surface of the front substrate 112. FIG. 2(*b*) shows an example where the ring-less getter G16 is fixed on the surface of the side plate 114. The arrangement of FIG. 2(*a*) and the arrangement of FIG. 2(*b*) may be combined together. That is, in a single fluorescent display tube, the ring-less getter G14, G15 can be fixed on the inner surface of the front substrate 112 and the ring-less getter G16 can be fixed on the side plate 114.

Figure 3:
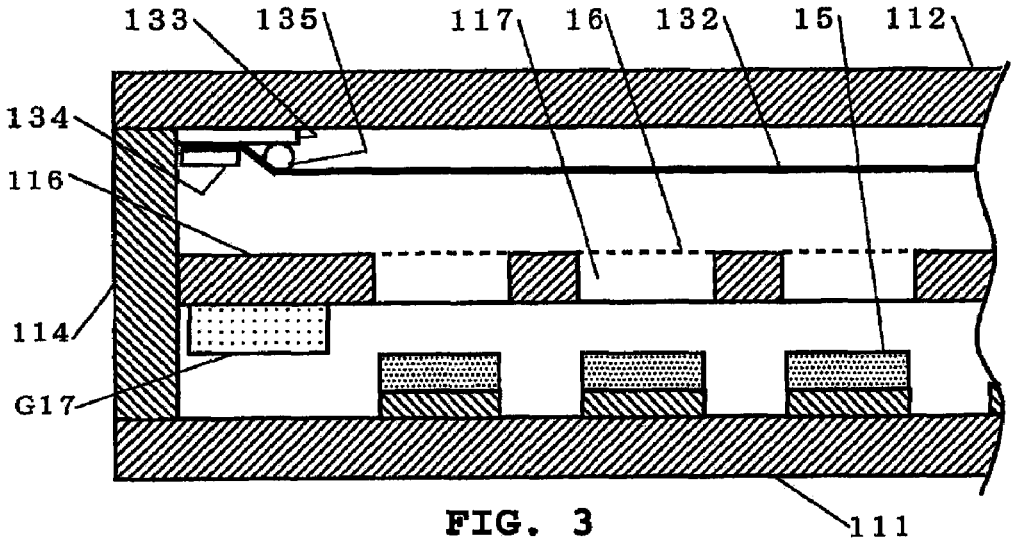
FIG. 3 is a cross-sectional view illustrating a fluorescent display tube according to a third embodiment of the present invention.

FIG. 3 is a cross-sectional view illustrating a fluorescent display tube according to the third embodiment of the present invention.

Referring to FIG. 3, each filament 132 is suspended above the front substrate 112 and the ring-less getter G17 is attached to the glass intermediate substrate 116.

The intermediate substrate 116, acting as a member for holding the grid 16, has openings 117 through which electrons emitted from the filament 132 can pass to the anode electrode 15. The intermediate substrate 116 may be used as an intermediate partition member in the envelope (or a hermetic container) of a fluorescent display tube.

The ends of each filament 132 are ultrasonically bonded to the metal layer (film), e.g., aluminum, acting as an anode mounting electrode formed on the front substrate 112. That is, each end of the filament 132 is sandwiched between the metal layer 133 and the metal piece 134 and the metal piece 134 is bonded to the metal layer 133 through the ultrasonic welding (including diffusion welding, friction welding, or solid phase junction). The spacer 135, such as an aluminum thin wire or a glass fiber, maintains the filament 132 in a predetermined height.

The ring-less getter G17 in FIG. 3 is bonded to one surface of the intermediate substrate 116 but may be bonded on both surfaces thereof. In such case, the ring-less getters are disposed on both surfaces in such a way that they are not overlapped.

Figure 4:
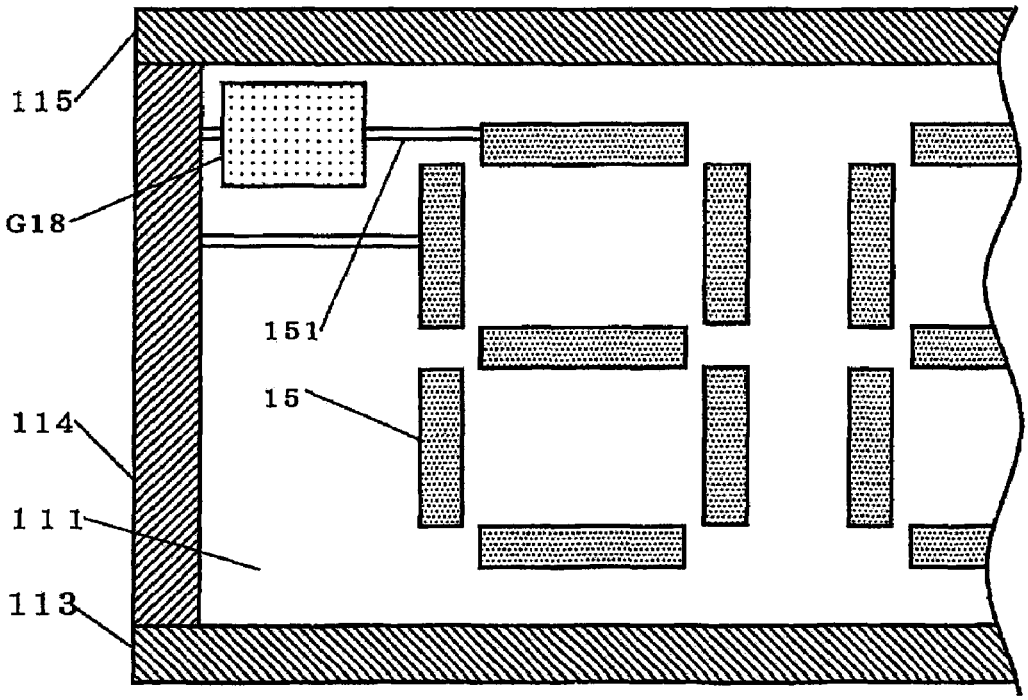
FIG. 4 is a cross-sectional view illustrating a fluorescent display tube according to a fourth embodiment of the present invention.
Figure 5A:
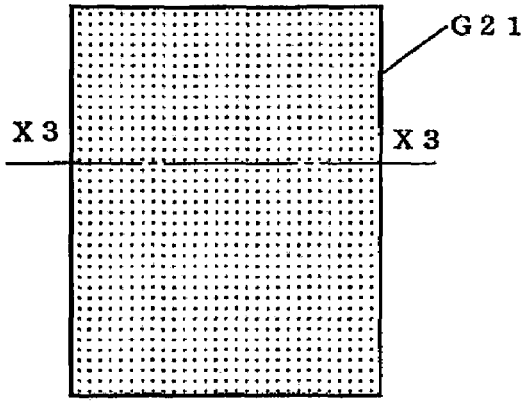
FIGS. 5(*a*), 5(*c*), 5(*d*), and 5(*e*) are plan views, each illustrating a ring-less getter according to an embodiment of the present invention and FIGS. 5(*b*) and 5(*f*) are cross-sectional views, each illustrating a ring-less getter according to an embodiment of the present invention.
Figure 5B:
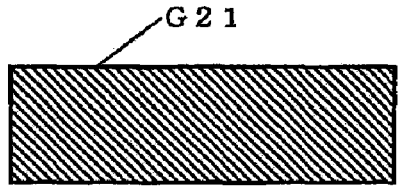
Figure 5C:
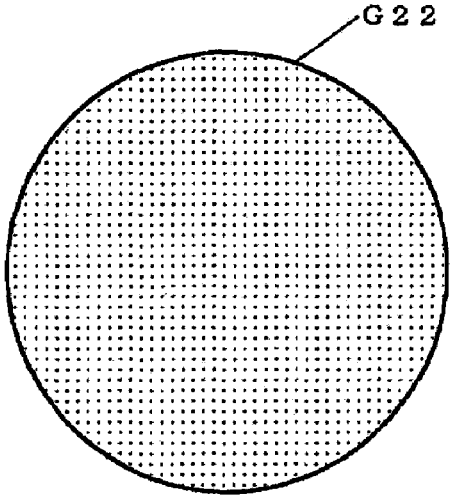
Figure 5D:
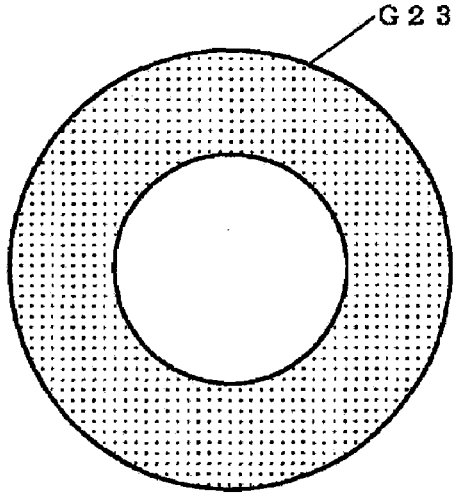
Figure 5E:
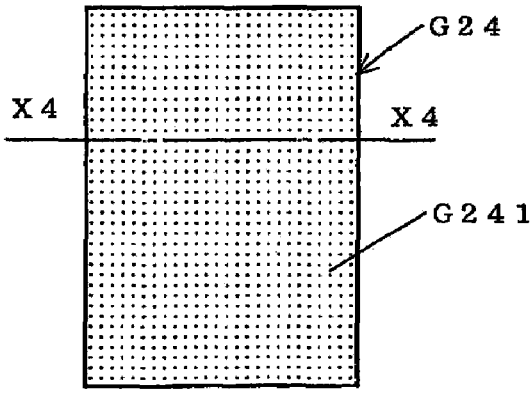
Figure 5F:
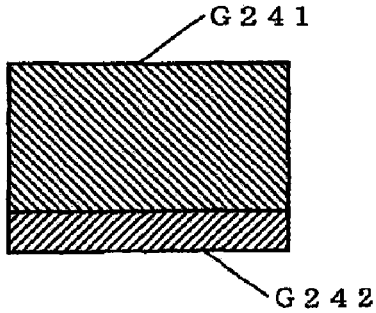

FIG. 4 is a cross-sectional view illustrating a fluorescent display tube according to the fourth embodiment of the present invention. Referring to FIG. 4, the ring-less getter G18 is bonded directly to the anode wiring conductor 151 (formed of a metal film such as aluminum) formed over the anode substrate 111, without intervening an insulating layer of SiO2 or SiN. Here, the anode wiring conductor means a conductor connected to an anode electrode and acting as a power supply point externally derived from the fluorescent display tube. (This is applicable to the cathode wiring conductor and the grid wiring conductor.) In this case, even if the anode wiring conductor 151 is fused during the bonding of the ring-less getter G18, the anode wiring conductor 151 does not disconnect at the ring-less getter G18 because the ring-less getter G18 is metal. The ring-less getter G18 flushes with the laser beam irradiated after the sealing of the fluorescent display tube (as described later). However, since the flushing does not cause the evaporation of all the ring-less getter G18, the anode wiring conductor 151 does not break down.

In the present embodiment, bonding the ring-less getter on the anode wiring conductor can make larger the degree of freedom in arrangement of a ring-less getter.

Similarly, that feature is applicable the case where the cathode wiring conductor, connected to the cathode electrode, formed on the cathode substrate (the front substrate) or the grid wiring conductor connected to the grid.

FIG. 5 is a plan view or a cross-sectional view illustrating a ring-less getter according to an embodiment of the present invention.

Each of FIGS. 5(*a*) and 5(*b*) shows the ring-less getter G21 press-molded in a rectangular shape. FIG. 5(*b*) is a cross-sectional view illustrating the portion taken along the line X3-X3 FIG. 5(*a*).

FIG. 5(*c*) shows the ring-less getter G22 press-molded in a disc shape. FIG. 5(*d*) shows the ring-less getter G23 press-molded in a doughnut shape.

Each of FIGS. 5(*e*) and 5(*f*) shows the ring-less getter G24 press-molded in a rectangular shape. FIG. 5(*f*) is a cross-sectional view illustrating the portion taken along the line X4-X4 of FIG. 5(*e*). The ring-less getter 24 is made of a getter material layer G241 and a metal layer G242, which is formed of a metal plate or a metal material layer such as aluminum. The ring-less getter is formed by integrally press-molding the getter material and the metal plate. The ring-less getter 24 is bonded with the meal layer G242 fixed to the fixing surface of the anode substrate. Indium, tin or its alloy, 426 alloy, aluminum, or the like may be used for the metal layer G242.

Compared with the case where only the getter material layer G241 is used, the ring-less getter 24 with the metal layer G242 is hard to be brittle and facilitates the work of bonding the ring-less getter G24.

The ring-less getter in FIG. 5 has an exemplary shape but may be formed in another shape. Plural ring-less getters, corresponding to the form of the getter mounting place, may be mounted in the fluorescent display tube. Thus, the dead spaces in the fluorescent display tube can be effectively utilized.

Figure 6A:
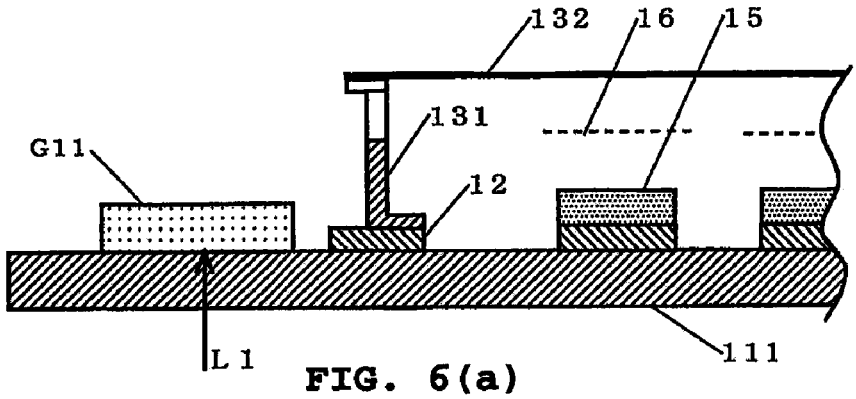
FIGS. 6(*a*), 6(*b*) and 6(*c*) are diagrams, each explaining a method for fixing a ring-less getter according to an embodiment of the present invention and a method for flushing the same.
Figure 6B:
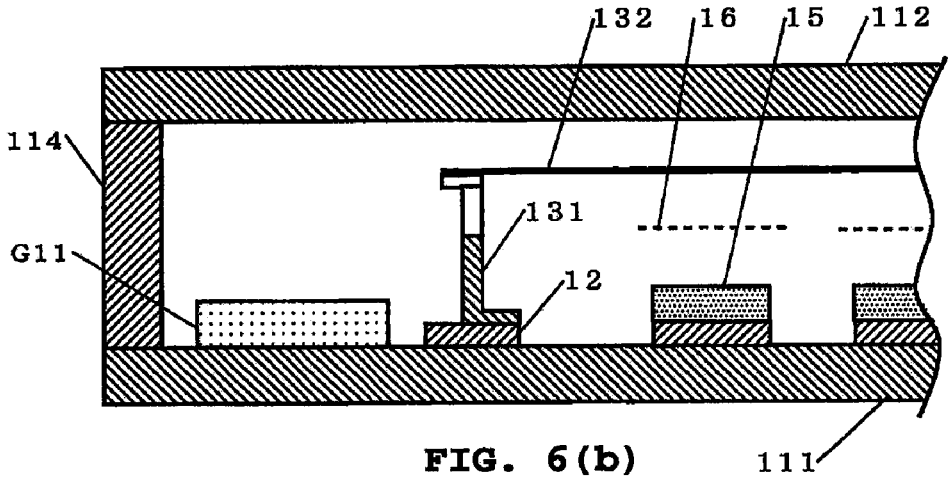
Figure 6C:
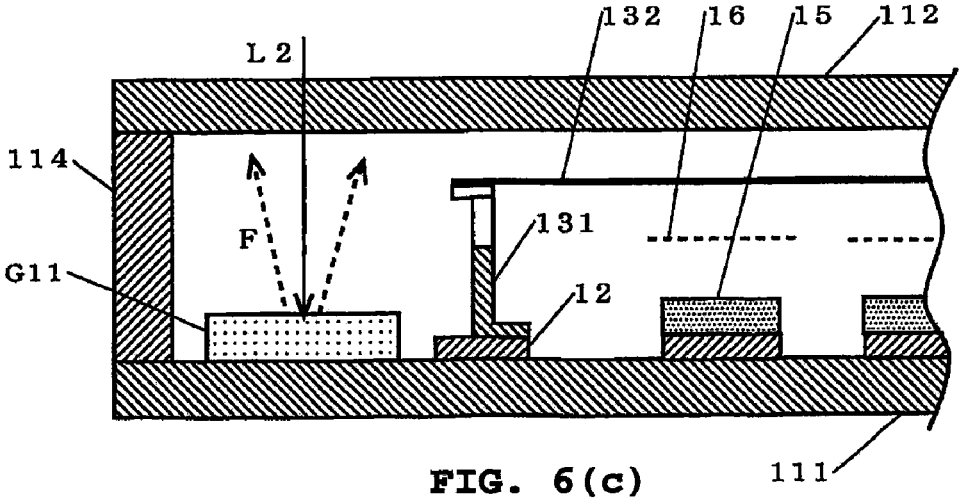
Figure 7A:
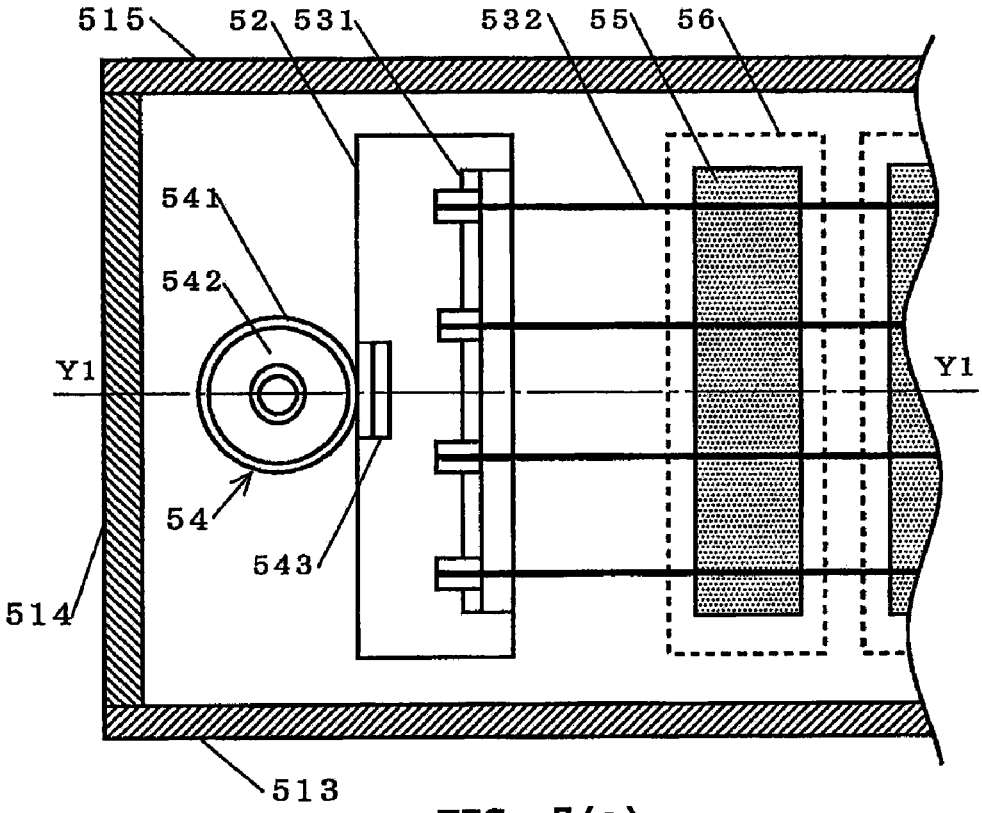
FIGS. 7(*a*) and 7(*b*), are cross-sectional views, each illustrating a fluorescent display tube with a conventional ring getter therein.
Figure 7B:
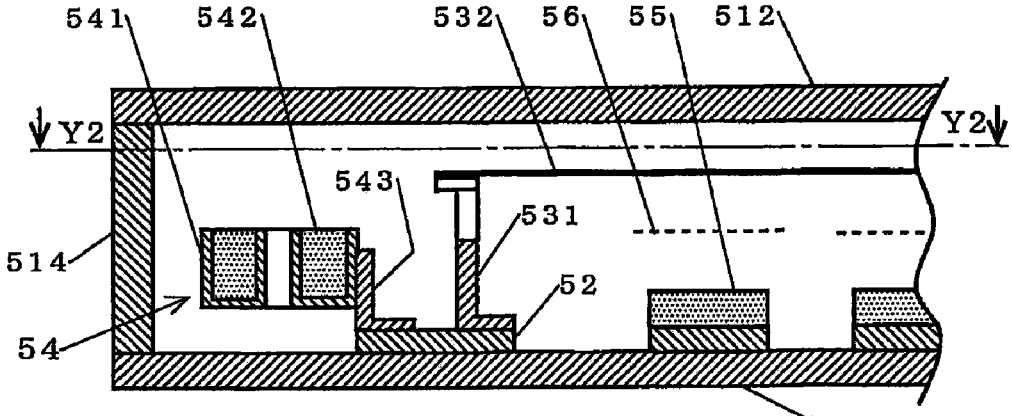
Figure 8A:
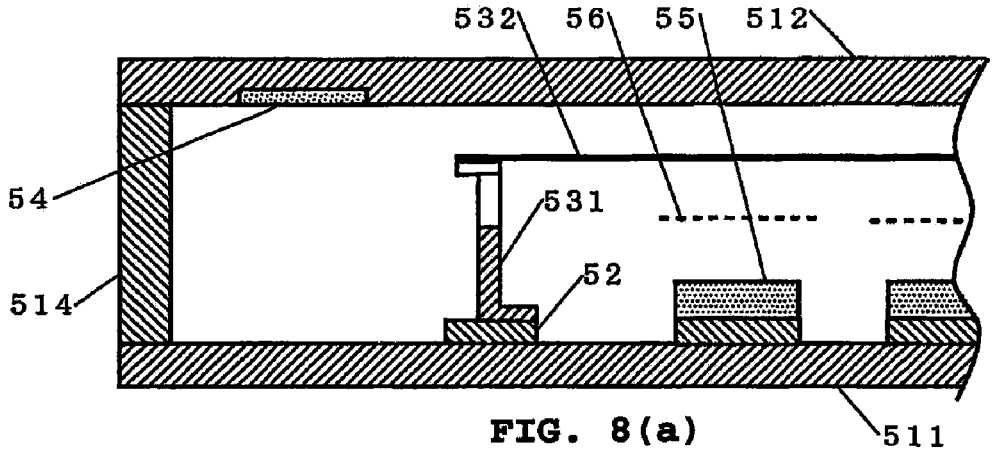
FIGS. 8(*a*), 8(*b*) and 8(*c*) are cross-sectional views, each illustrating a fluorescent display tube with a conventional ring-less getter therein.
Figure 8B:
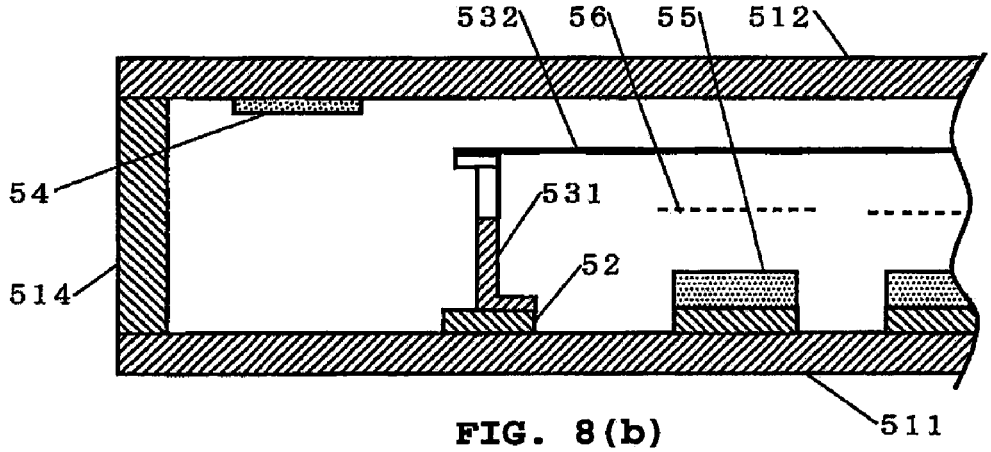
Figure 8C:
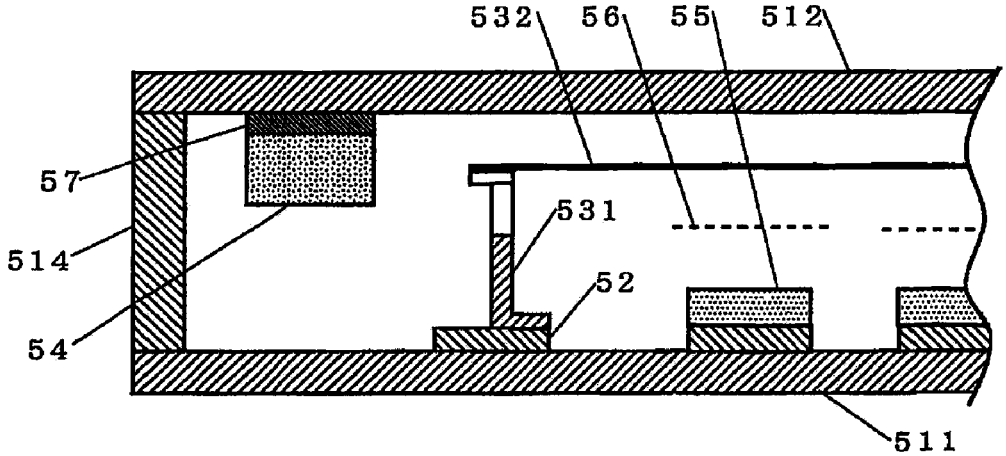

FIG. 6 is a diagram explaining a ring-less getter fixing method and a ring-less getter flush activating method, each according to an embodiment of the present invention.

As shown in FIG. 6(*a*), a laser beam L1 is irradiated onto the ring-less getter G11 disposed on the inner surface of the anode substrate 111 from outside the anode substrate 111. There are a method of temporarily mounting a ring-less getter G11 with a low-temperature degradable adhesive agent such as acrylic and a method of mechanically cramping a ring-less getter and then pressing it to the anode substrate. The laser beam L1 impinges on the ring-less getter G11 through the anode substrate 111, without substantial absorption. The ring-less getter G1 is heated and fused with the laser beam L1. The laser beam L1 passing through the anode substrate 111 does not heat the anode substrate 111. However, the anode substrate 111 is heated through the heating of the ring-less getter G11. Thus, the portion of the anode substrate 111, which is in contact with the ring-less getter G11, melts. In such a state, both the ring-less getter G11 and the anode substrate 11 are cooled, the molten portions thereof are solidified so that the ring-less getter G11 is securely fixed to the anode substrate 111.

A conventional getter material may be used for the ring-less getter G11. However, when a mixture of BaAl4, MaAl and Ni, Ti, Fe are used, it reacts chemically with Al, Ni, so that the reaction heat generates. Since the reaction heat increases the ring-less getter G11 to a temperature of 1050° C., the inner surface of the anode substrate 111 (which is in contact with the ring-less getter G11) fuses rapidly. The ring-less getter material having a low transmittance (other than total transmission) of a laser beam, that is, an optical energy, is suitably selected.

The inventor of this application focused an attention on the fact that as the laser beam L1 heats the ring-less getter G11 through the glass anode substrate 111, the anode substrate 111 thermally melts through the heating of the ring-less getter G11. Thus, the present inventor invented the method of bonding the ring-less getter G11 to the anode substrate 111 through the irradiation of the laser beam L1.

The laser beam L1 may be illuminated through the laser marker system or the dot spot system. The laser may be YAG laser, excimer laser, carbon dioxide laser, or the like.

The glass substrate can pass wavelengths ranging from visible rays to 1.06 μm used with the YAG laser. Particularly, the glass substrate indicating a high transmittance of 1.06 μm is effective for the YAG laser.

The present embodiment uses a disc ring-less getter having a diameter of 2 mm and a thickness of 0.5 mm and a flat ring-less getter having a size of 2 mm×10 mm and a thickness of 0.5 mm. The ring-less getter is fixed to a 1.1 mm-thick soda glass substrate. A non-alkali glass may be used for the glass substrate.

In the laser marker system, a YAG laser is used and 17 W, 10 kH, and 20 mm/second are set for the laser beam conditions.

In the laser marker system, the adhesive strength (or the shear strength) of the disc ring-less getter is 20 N and the adhesive strength of the flat ring-less getter is 60 N or more. With the same size and the same conditions, the adhesive strength in the laser marker system was improved 20 times, compared with the adhesive strength of the ring-less getter bonded with the fritted glass. Here, the shear strength means the force of peeling off the ring-less getter from the anode substrate when a force is applied from the side surface thereof to a ring-less getter bonded on the anode substrate in the direction in parallel with the anode substrate. In other words, the shear strength means a maximum force for peeling off a ring-less getter.

As shown in FIG. 6(*b*), after the ring-less getter G11 is bonded to the anode substrate 111, a fluorescent display tube is assembled through the conventional assembly process and then is evacuated for sealing.

As shown in FIG. 6(*c*), the laser beam L2 is irradiated onto the ring-less getter G11 from the outside the front substrate, that is, from the outside of the envelope (or hermetic container) of the fluorescent display tube. Thus, the ring-less getter G11 activates (flushes) and the particles of the evaporated (flushed) getter material sputter in the direction of the arrow F. As a result, a getter mirror film (not shown) is formed over an inner surface of the front substrate 112, that is, over an inner surface of the envelope of the fluorescent display tube. The laser beam L2 may impinge onto the side surface of the ring-less getter G11 from the outside of the side plate 114 so that the getter mirror film of Ba can be formed over an inner surface of the side plate 114.

With the illumination conditions of 8 W, 5 kH, and 100 mm/second, the laser beam is irradiated according to the laser marker system.

In the above-mentioned embodiments, the example has been explained where the ring-less getter is bonded to the anode substrate, the front substrate, the side plate, or the grid holding intermediate substrate. However, the member for fixing the ring-less getter is not limited only to the above-embodiments. The ring-less getter can be fixed with the glass member disposed in the envelope of a fluorescent display tube, for example, with a glass pillar (support or spacer) or a glass plate which can prevent an evaporated getter material from being sputtered toward the display surface, the electrodes, or others. In the present invention, a glass member for fixing the ring-less getter is called a glass substrate.

In each above-mentioned embodiment, the example has been explained where a ring-less getter is fixed to each glass substrate. However, the ring-less getter may be fixed to plural glass substrates. The glass substrate, on which a ring-less getter is fixed, as well as the location for fixing may be suitably selected according to the configuration of a fluorescent display tube.

The example of bonding and flushing the ring-less getter with the laser beam has been explained. However, an optical energy, except laser beam, may be used.

In each embodiment, the evaporation-type getter has been explained. However, a non-evaporation-type getter containing a main constituent such as Zr, Ti, Ta, and the like may be employed. The non-evaporation-type getter is heated to an activation temperature, without flushing, to provide the gas adsorption capability. However, an optical energy may be used to heat the non-evaporation-type getter.

In each embodiment, a fluorescent display tube has been explained. However, field emission fluorescent displays, luminous tubes for large-screen display devices, luminous tubes for fluorescent print heads, electron tube, such as CRTs, belonging to vacuum tubes, electron tubes, such as PDPs, belonging to discharge tubes, or electron devices such as ELDs may be used in each embodiment. When the electron device is either an electron tube belonging to a discharge tube or an ELD, a non-evaporation type ring-less getter is used. The PDP employs a getter material that can adsorb nitrogen and oxygen. The FED, particularly, an organic FED uses a getter material that can adsorb moisture. In the organic FED, organic luminous elements each having a first electrode, an organic layer including a luminous layer formed on the first electrode, and a second electrode formed on the organic layer, are contained in a hermetic container. Moreover, in the FED, the hermetic container is formed of a resin such as plastic or polymer film. When the resin is transparent or is transparent to an optical energy, the ring-less getter can be bonded onto the inner surface of the hermetic container with the optical energy, without heating the resin.

In each embodiment, the case where has been described all substrates including an anode substrate, a front substrate, a side plate, or a grid holding intermediate substrate are made of glass. However, it is not always required that all the substrates are made of glass. It is merely required that the substrate to which the ring-less getter is bonded is at least of glass. Alternatively, it is merely requires that the portion of a substrate at which a ring-less getter is bonded is at least of glass.

Similarly, when the ring-less getter is activated, all portions or part of a substrate confronting the ring-less getter (or of a substrate allows which the passing of an optical energy irradiated to a ring-less getter) may be of glass.

INDUSTRIAL APPLICABILITY

The ring-less getter of the present invention has a simplified structure and can be bonded onto a glass substrate merely by irradiating the laser beam onto the ring-less getter. Accordingly, the mounting work can be simplified and automated easily.

According to the present invention, since the ring-less getter can be bonded to a glass substrate, the degree of freedom becomes larger when a ring-less getter is disposed. For example, the ring-less getter can be bonded onto metallization (an electrode wiring conductor) such as an anode wiring conductor.

In the present invention, both the ring-less getter and the glass substrate are once fused and solidified, the ring-less getter can be rigidly securely bonded onto the glass substrate.

Moreover, since the fritted glass is not used to bond the ring-less getter, it can be avoided that gases produced from the fritted-glass during the flushing of the ring-less getter block the electron emission of an electron source such as a filament.

According to the present invention, the laser beam bonds the ring-less getter onto the glass substrate and flushes the ring-less getter. Therefore, by merely changing the laser beam illumination conditions, the same laser beam illuminator can be shared for the mounting and flushing of a ring-less getter.

Moreover, the ring-less getter, which is made through merely press-molding the getter material powder, has its simple structure and can be fabricated easily and inexpensively. Moreover, the ring-less getter can be molded in a given shape and hence can be fabricated in the shape corresponding to a dead space in the electron device. Accordingly, a combination of ring-less getters different in shape enables effectively using dead spaces in the electron device.

Moreover, the press-molded ring-less getter can be set to a given thickness. Therefore, the ring-less getter formed of a getter material enough to adsorb the residual gases can be mounted in the electron device.

The invention claimed is:

1. A method of fixing a ring-less getter, comprising the steps of:

disposing a ring-less getter on a glass substrate in an electron device, wherein a surface of said ring-less getter is in direct contact with said glass substrate;

irradiating an optical energy onto said ring-less getter from a surface of said glass substrate, opposite to a surface of said glass substrate on which said ring-less getter is disposed;

fusing the contacting surfaces of said ring-less getter and glass substrate by said optical energy; and bonding said ring-less getter on said glass substrate by cooling the fused contacting surfaces of said ring-less getter and glass substrate.

2. The method defined in claim 1, wherein said optical energy is a laser beam.

3. The method defined in claim 2, wherein said laser beam is illuminated through one of a laser marker system and a dot spot system.

4. The method defined in claim 2, wherein said laser is one of: a YAG laser, an excimer laser, and a carbon dioxide laser.

5. The method defined in claim 1, wherein said ring-less getter is formed of a mixture of at least two of: $BaAl_4$, MgAl, Ni, Ti, and Fe.

6. The method defined in claim 1, wherein said glass substrate is one of: an anode substrate, a front substrate, a side plate, and a grid holding intermediate substrate.

7. The method defined in claim 1, wherein said electron device is one of: a vacuum fluorescent display, a field emission fluorescent display, a fluorescent print head, a plasma display panel, an electroluminescent display, and a cathode ray tube.

8. A method for activating a ring-less getter, comprising the steps of:

disposing a ring-less getter on a glass substrate in an electron device; wherein a surface of said ring-less getter is in direct contact with said glass substrate;

irradiating an optical energy onto said ring-less getter from a surface of said glass substrate, opposite to a surface of said glass substrate on which said ring-less getter is disposed;

fusing the contacting surfaces of said ring-less getter and glass substrate by said optical energy;

bonding said ring-less getter on said glass substrate by cooling the fused contacting surfaces of said ring-less getter and glass substrate; and irradiating an optical energy on a surface of said ring-less getter opposing the fused contacting surfaces to activate said ring-less getter.

9. The method defined in claim 8, wherein said optical energy is a laser beam.

10. The method defined in claim 9, wherein said laser beam is illuminated through one of a laser marker system and a dot spot system.

11. The method defined in claim 9, wherein said laser is one of: a YAG laser, an excimer laser, and a carbon dioxide laser.

12. The method defined in claim 8, wherein said ring-less getter is formed of a mixture of at least two of: $BaAl_4$, MgAl, Ni, Ti, and Fe.

13. The method defined in claim 8, wherein said glass substrate is one of: an anode substrate, a front substrate, a side plate, and a grid holding intermediate substrate.

14. The method defined in claim 8, wherein said electron device is one of: a vacuum fluorescent display, a field emission fluorescent display, a plasma display panel, an electroluminescent display, and a cathode ray tube.

15. An electron device comprising:

a hermetic container formed with a glass substrate; and a ring-less getter disposed in said hermetic container; wherein a surface of said ring-less getter is in direct contact with said glass substrate; said ring-less getter being fused onto said glass substrate by irradiating a laser beam on the contacting surfaces of said ring-less getter and said glass substrate from a surface of said glass substrate opposite to the surface of said glass substrate on which said ring-less getter is disposed.

16. The electron tube defined in claim 15, wherein said hermetic container is formed with an anode substrate and a front substrate.

17. The electron tube defined in claim 16, wherein said ring-less getter is bonded onto said anode substrate.

18. The electron tube defined in claim 16, wherein said ring-less getter is bonded onto said front substrate.

19. The electron tube defined in claim 16, wherein a plurality of ring-less getters are bonded onto said anode substrate.

20. The electron tube defined in claim 16, wherein said hermetic container further includes a side plate; wherein said ring-less getter is bonded onto said side plate.

* * * * *